US011592231B2

(12) United States Patent
Akalan et al.

(10) Patent No.: US 11,592,231 B2
(45) Date of Patent: Feb. 28, 2023

(54) REFRIGERATION DEVICE WITH REINFORCED HOUSING

(71) Applicant: BSH HAUSGERAETE GMBH, Munich (DE)

(72) Inventors: Yigit Akalan, Tekirdag (TR); Samuel Harward, Knoxville, TN (US); Cemalettin Hasturk, Knoxville, TN (US); Toygun Karakaya, Tekirdag (TR); Erhan Kaya, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 17/367,801

(22) Filed: Jul. 6, 2021

(65) Prior Publication Data

US 2022/0099360 A1 Mar. 31, 2022

(30) Foreign Application Priority Data

Sep. 30, 2020 (TR) ..... 2020/15497

(51) Int. Cl.
*F25D 23/06* (2006.01)

(52) U.S. Cl.
CPC ..... *F25D 23/067* (2013.01); *F25D 23/062* (2013.01); *F25D 2400/04* (2013.01)

(58) Field of Classification Search
CPC .... F25D 23/067; F25D 23/062; F25D 23/065; F25D 2400/04
See application file for complete search history.

(56) References Cited

U.S. PATENT DOCUMENTS

| | | | | |
|---|---|---|---|---|
| 4,632,470 | A * | 12/1986 | Jenkins | F25D 23/062 312/138.1 |
| 5,064,255 | A * | 11/1991 | Inui | F25D 23/02 49/504 |
| 5,349,832 | A * | 9/1994 | Johnson | E05D 5/06 62/272 |
| 8,864,253 | B2 * | 10/2014 | Gorz | F25D 23/064 312/406 |
| 10,215,471 | B2 * | 2/2019 | Grimm | F25D 21/04 |
| 10,907,883 | B2 * | 2/2021 | Dherde | E05D 7/081 |
| 2004/0012315 | A1 * | 1/2004 | Grace | F25D 23/062 312/406 |
| 2019/0011174 | A1 * | 1/2019 | Dherde | E05D 15/266 |

(Continued)

FOREIGN PATENT DOCUMENTS

| | | |
|---|---|---|
| EP | 0206258 B1 | 3/1992 |
| EP | 1566603 A1 | 8/2005 |

(Continued)

*Primary Examiner* — Daniel J Rohrhoff
(74) *Attorney, Agent, or Firm* — Laurence A. Greenberg; Werner H. Stemer; Ralph E. Locher

(57) ABSTRACT

A refrigeration device includes a cabinet surrounded by a thermally-insulated housing having a sidewall facing outside and an inner liner spaced apart from the sidewall. At least one door is hinged to the housing by at least one hinge element and a front frame part is provided at a side of the housing facing the door. The housing includes a reinforcing member provided at a region of the housing adjacent a respective hinge element, so as to connect a pair of frame parts extending vertically between the sidewall and the inner liner to each other and to the respective hinge element and sidewall.

14 Claims, 8 Drawing Sheets

(56) References Cited

U.S. PATENT DOCUMENTS

| | | | | |
|---|---|---|---|---|
| 2019/0277556 | A1 | 9/2019 | Chen et al. | |
| 2021/0172673 | A1 * | 6/2021 | Guo | F25D 23/065 |

FOREIGN PATENT DOCUMENTS

| | | | | |
|---|---|---|---|---|
| JP | H06129753 | A | 5/1994 | |
| JP | H07305946 | A | 11/1995 | |
| WO | WO-2014071490 | A1 * | 5/2014 | F25D 23/067 |

* cited by examiner

REFRIGERATION DEVICE WITH REINFORCED HOUSING

CROSS-REFERENCE TO RELATED APPLICATION

This application claims the priority, under 35 U.S.C. § 119, of Turkish Patent Application TR 2020/015497, filed Sep. 30, 2020; the prior application is herewith incorporated by reference in its entirety.

BACKGROUND OF THE INVENTION

Field of the Invention

The present invention relates to a refrigeration device including a cabinet, a thermally-insulated housing which surrounds the cabinet and has a sidewall facing outward and an inner liner spaced apart from the sidewall, and at least one door which is hinged to the housing by at least one hinge element.

The region of the housing where the door is hinged to the housing, is exposed to forces during the lifecycle of the refrigeration devices. Therefore, that region of the housing should have a more rigid structure.

European Patent EP 0206258 B1, corresponding to U.S. Pat. No. 4,632,470, discloses a refrigerator cabinet having an outer metal case including side walls and a top wall, a plastic inner liner and a partition separating freezer and fresh food compartments and separate front door openings. A front face is formed along the front edge of the side walls and top wall defining the door openings. The front face along each side wall is provided with a first pair of vertically spaced openings disposed in the area adjacent the partition and a lower pair of vertically spaced openings disposed in the lower end of the front face. A support frame system is provided including vertically extending side support bars, each having pairs of vertically spaced upper and lower openings dimensioned to align with the upper and lower openings in the front face. An upper cross member extending between the side walls is positioned adjacent the front portion of the partition and a lower cross member extending between the lower edge portion of the side walls. The upper and lower cross members include a pair of vertically spaced openings adjacent each end thereof which are cooperatively disposed relative to the upper and lower pair of vertically spaced openings in the front face and support bar. Securing devices cooperating with the aligned upper and lower pairs of vertically spaced openings in the front face, support bar and their respective cross members for securely holding the cross members substantially perpendicular relative to the cabinet side walls thereby ensure that the front door openings are maintained in a substantially square relationship.

BRIEF SUMMARY OF THE INVENTION

It is accordingly an object of the invention to provide a refrigeration device with a reinforced housing, which overcomes the hereinafore-mentioned disadvantages and provides an additional improvement, advantage or alternative to the heretofore-known devices of this general type and has a more resistant-structured housing.

With the foregoing and other objects in view there is provided, in accordance with the invention, a refrigeration device, comprising a cabinet surrounded by a thermally-insulated housing having a sidewall facing outside and an inner liner spaced apart from the sidewall, at least one door hinged to the housing by at least one hinge element, and a front frame part provided at a side of the housing facing the door. In the invention, the housing further includes a reinforcing member provided at a region of the housing adjacent the respective hinge element, so as to connect a pair of frame parts extending vertically between the sidewall and the inner liner, to each other, and to the respective hinge element and sidewall. Thus, the rigidity of the region of the housing which is adjacent the hinge element, is improved. Therefore, the refrigeration device has a more resistant-structured housing.

In a possible embodiment of the invention, the reinforcing member is configured to extend in a vertical direction of the housing. Thus, the rigidity of the housing is improved in the vertical direction. Therefore, possible undesired convex tendencies in the vertical direction, are prevented.

In a possible embodiment of the invention, the reinforcing member is located at a middle region of the housing in the vertical direction. Thus, the region of the housing which is adjacent the hinge element is improved against movement or deformation. Therefore, the desired rigidity is achieved.

In a possible embodiment of the invention, the reinforcing member has a three-sided connection surface. Thus, the reinforcing member provides a connection between the frame parts, the hinge support member and the sidewall.

In a possible embodiment of the invention, the housing includes a hinge connection housing where the hinge element connects to the housing, provided on a front side of the housing facing the door, and a hinge support part is provided in the hinge connection housing. Thus, the hinge member connects to the housing from one side.

In a possible embodiment of the invention, the reinforcing member has a first side surface facing the sidewall, where a plurality of connection holes are provided. Thus, the connection of the reinforcing member to the side wall, the frame parts and the hinge support member is achieved.

In a possible embodiment of the invention, the sidewall has a plurality of connection openings which correspond to the connection holes. Thus, the connection of the reinforcing member to the side wall, the frame parts and the hinge support member is achieved from outside in an easy manner.

In a possible embodiment of the invention, the reinforcing member has one or more first connection holes provided on the first side surface in order to connect the reinforcing member to the sidewall and the respective frame parts by using a connection element that passes through the first connection hole, the sidewall and the respective frame parts. Thus, the reinforcing member connects to the sidewall and the respective frame parts.

In a possible embodiment of the invention, the reinforcing member has one or more second connection holes provided on the first side surface, for connecting the reinforcing member to the hinge support part by using a connection element, from outside of the housing. Thus, the reinforcing member connects to the hinge support part from outside in an easy manner.

In a possible embodiment of the invention, the reinforcing member includes two connection lugs provided at the opposite sides, which at least partly overlap a part of the respective frame parts. Thus, the reinforcing member connects to the respective frame parts.

In a possible embodiment of the invention, each of the connection lugs have one or more third connection hole for connecting the reinforcing member to the respective frame parts by using a connection element which passes through the third connection hole and the respective frame parts. Thus, the reinforcing member connects to the respective frame parts.

In a possible embodiment of the invention, the reinforcing member has one or more fourth connection hole provided on a surface which is perpendicular to the first side surface. Thus, the reinforcing member connects to the hinge support part.

In a possible embodiment of the invention, the housing includes two reinforcing members provided at the opposite sides of the housing for the regions of the housing adjacent the respective hinge elements of the related doors. Thus, the reinforcing members are provided for both of the doors.

In a possible embodiment of the invention, the reinforcing member is made from a metal material, in particular a steel material. Thus, the reinforcing member is made from a resilient material in order to improve the rigidity of the housing.

In this context, the indications "top," "bottom," "front," "rear," "horizontal," "vertical," "upward," "downward," "inner," "outer," "inward," "outward," etc. indicate the positions and orientations given for intended use and intended configuration of the refrigeration device and for a user standing in front of the refrigeration device in a closed position and viewing in the direction of the device.

Each possible embodiment disclosed in this text can be combined with the other possible embodiments disclosed in this text if there is not any technical constraint.

Other features which are considered as characteristic for the invention are set forth in the appended claims.

Although the invention is illustrated and described herein as embodied in a refrigeration device with a reinforced housing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

The figures, which are briefly explained herein, are solely intended for providing a better understanding of the present invention and are as such not intended to define the scope of protection or the context in which that scope is to be interpreted in the absence of the description.

DETAILED DESCRIPTION OF THE INVENTION

In this detailed description, the subject matter is explained with references to examples without forming any restrictive effect and only in order to make the subject more understandable.

Figure 1:
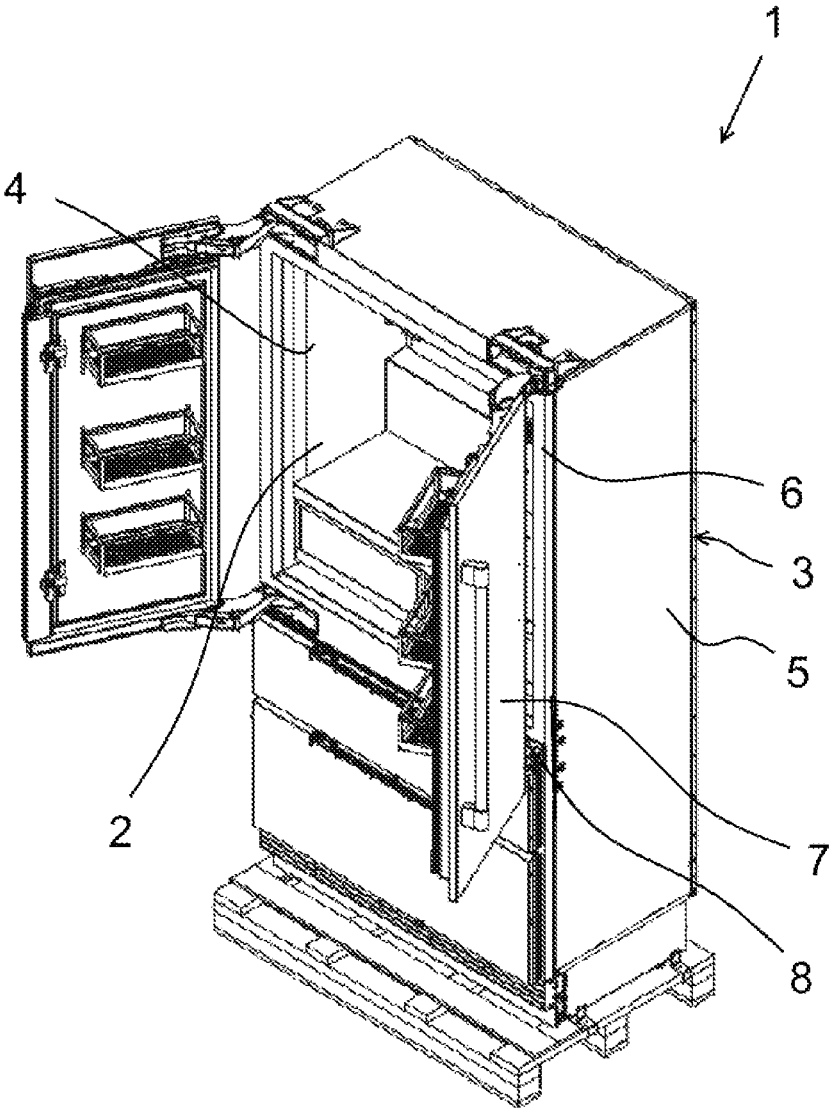
FIG. 1 is a diagrammatic, perspective view of the exemplary refrigeration device.

Referring now to the figures of the drawings in detail and first, particularly, to FIG. 1 thereof, there is seen a refrigeration device 1 which includes a cabinet 2 surrounded by a thermally-insulated housing 3. The cabinet 2 can be a freezer compartment or a fridge compartment. The thermally-insulated housing 3 has a sidewall 5 facing outside and an inner liner 4 spaced apart from the sidewall 5. The cabinet 2 has an access opening for accessing the interior of the cabinet 2 from outside. At least one door 7 is hinged to the housing 3 by at least one hinge element 8 for opening/closing the access opening. As can be seen in FIG. 1, the exemplary refrigeration device 1 has a pair of doors 7 hinged to the housing 3. The pair of doors can be a French-type door. The housing 3 further includes a front frame part 6 provided at a side of the housing 3 facing the door 7. The front frame part 6 connects to the inner liner 4 from one side and to the sidewall 5 from the other side. An insulation material (not shown) fills a spacing between the inner liner 4, the sidewall 5 and the front frame part 6.

Figure 2:
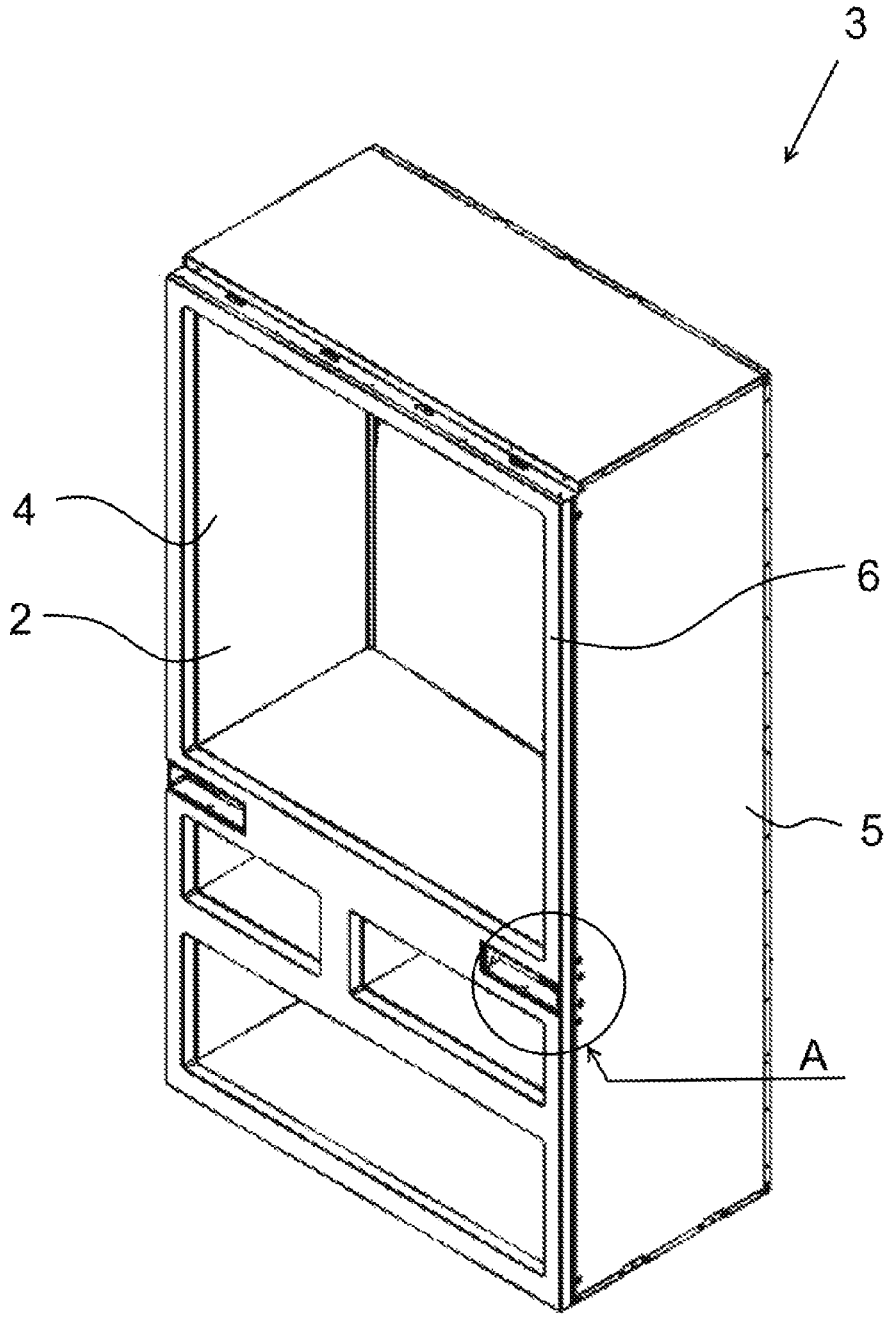
FIG. 2 is a perspective view of the housing of the exemplary refrigeration device.
Figure 3:
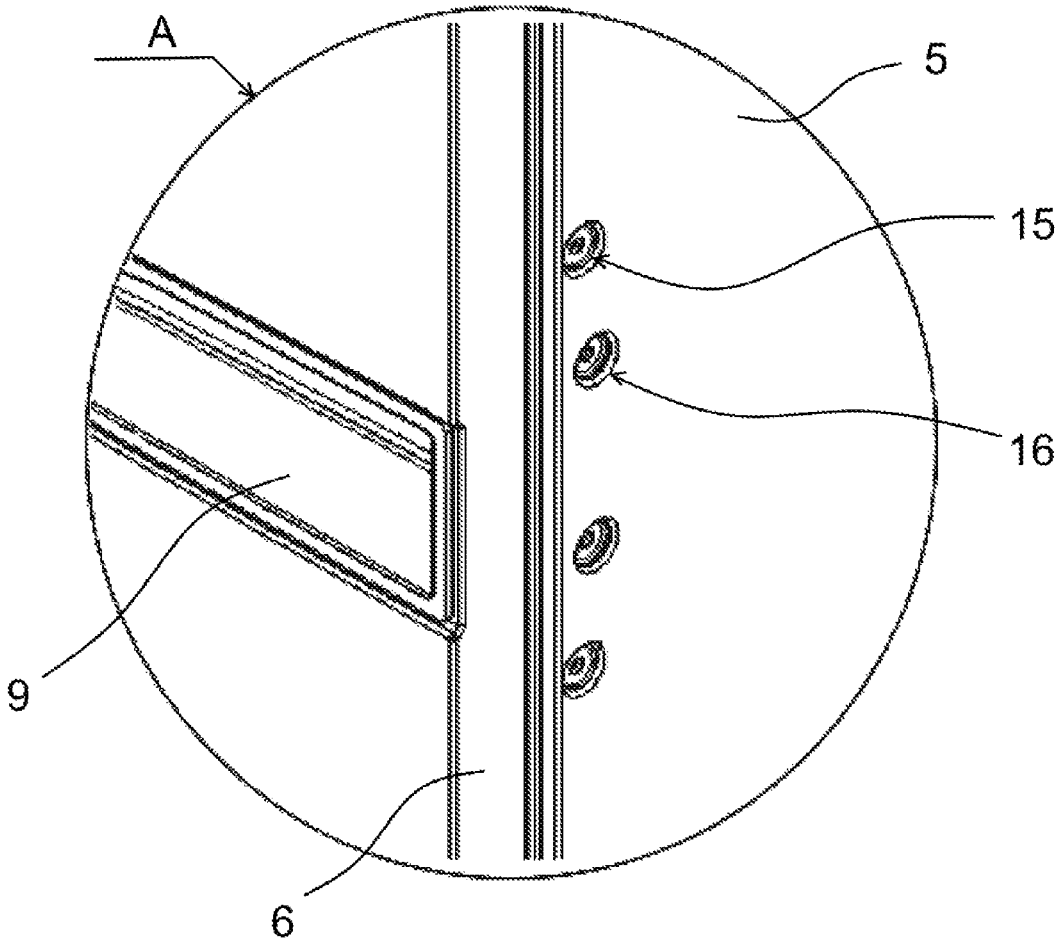
FIG. 3 is an enlarged, detailed view of a region A of the housing shown in FIG. 2 that is adjacent the hinge element.
Figure 4:
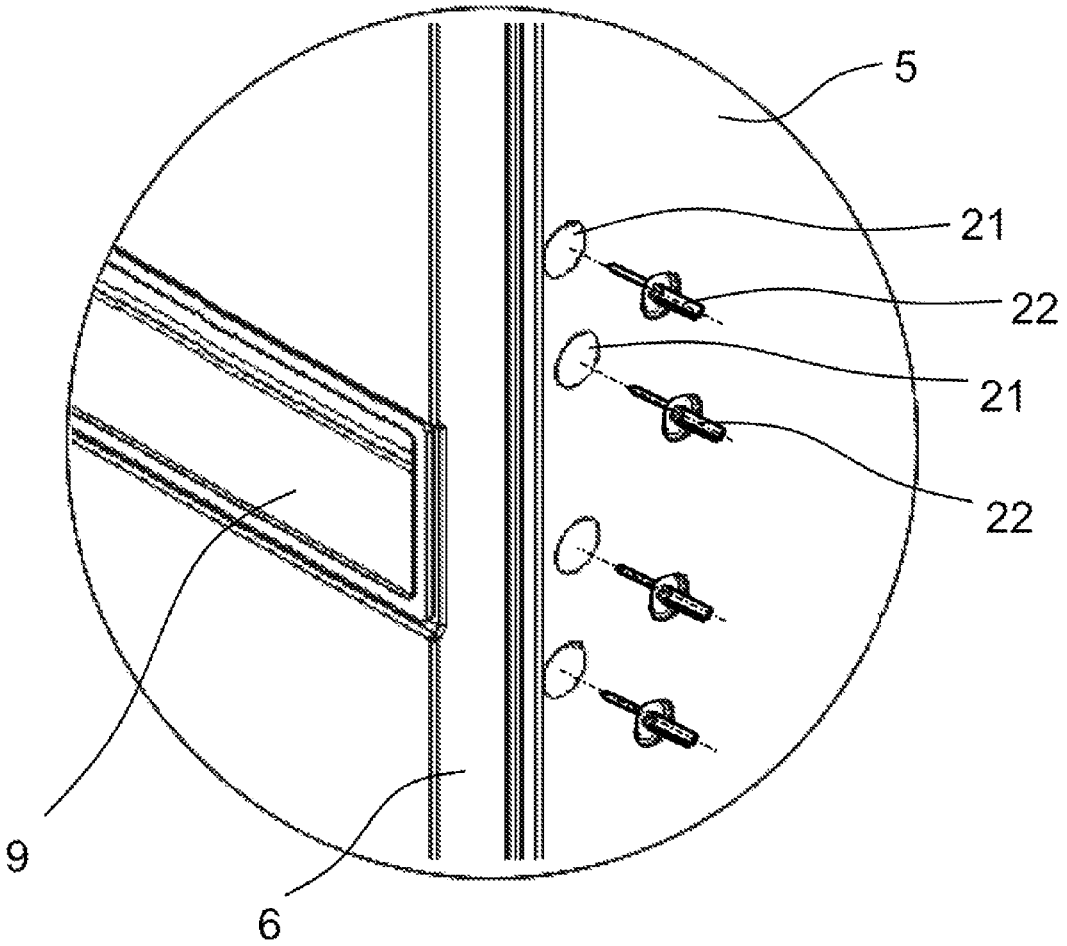
FIG. 4 is a detailed, exploded view of the region of the housing that is adjacent the hinge element.
Figure 5:
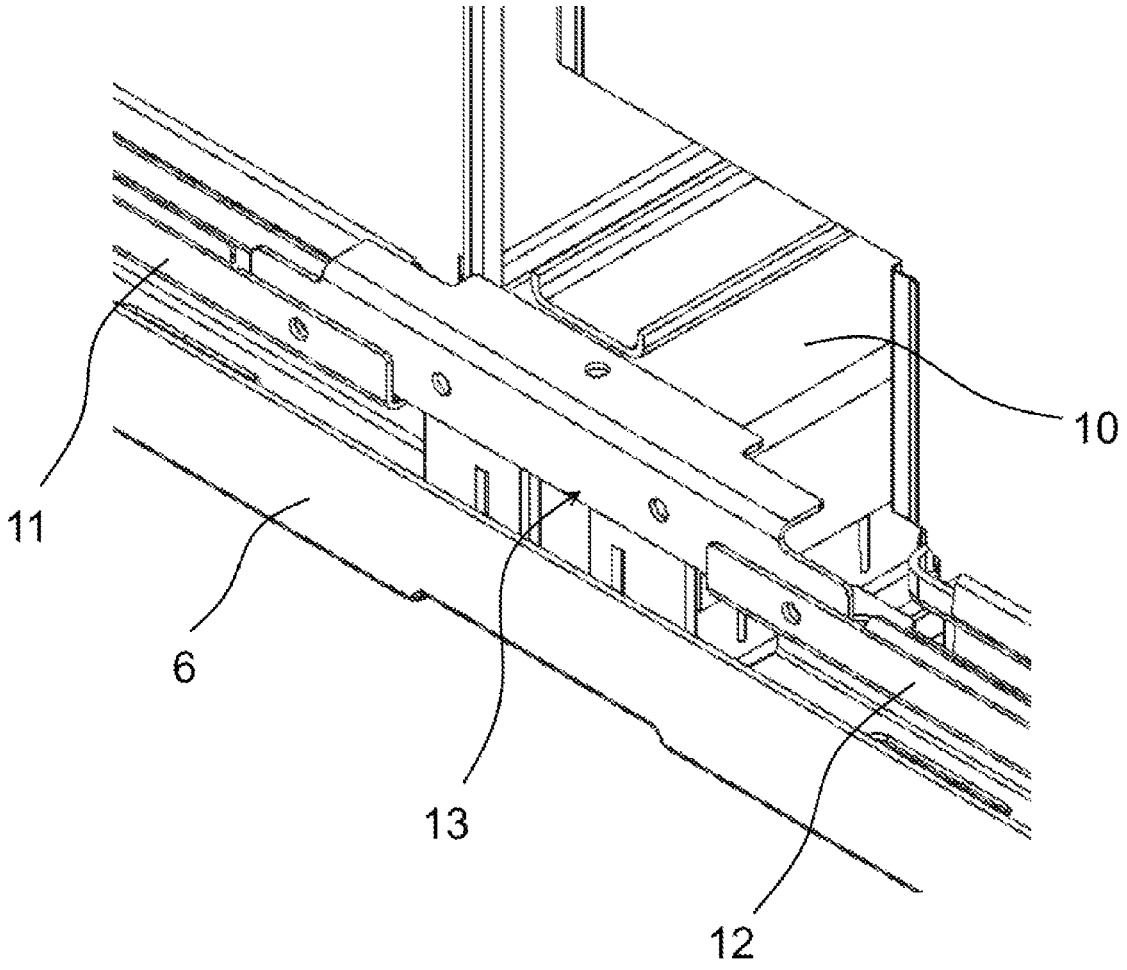
FIG. 5 is a detailed, perspective view of the region of the housing where the reinforcing member is provided.
Figure 6:
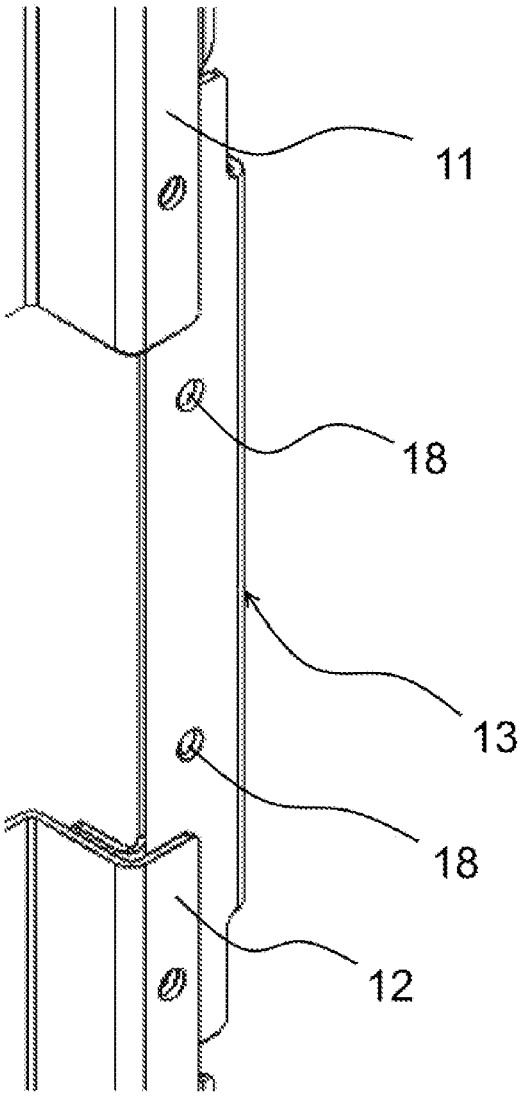
FIG. 6 is a detailed, perspective view of the frame parts and the reinforcing member.

As can be seen in FIGS. 2 and 5, in a possible embodiment of the invention, the housing 3 further includes a reinforcing member 13 provided at a region of the housing 3 adjacent the respective hinge element 8. The reinforcing member 13 connects a pair of frame parts 11, 12 extending vertically between the sidewall 5 and the inner liner 4, to each other, and to the respective hinge element 8 and sidewall 5. In FIG. 3, detail A shows the region of the housing 3 adjacent the respective hinge element 8. The hinge element 8 attaches to a hinge connection housing 9 provided at a front side of the refrigeration device 1 facing the door 7. At least one first connection region 15 and at least one second connection region 16 are provided in the region of the housing 3. In a possible embodiment, there are two first connection regions 15 and two second connection regions 16 provided in the region of the housing 3. In FIG. 4, detail A shows the exploded view of the region of the housing 3 adjacent the respective hinge element 8. The sidewall 5 has a plurality of connection openings 21. A connection element 22 passes through each of the connection openings 21. Preferably, the connection element 22 is a rivet element.

With reference to FIG. 5, in a possible embodiment of the invention, the reinforcing member 13 is located at a middle region of the housing 3 in the vertical direction. The reinforcing member 13 is configured to extend in a vertical direction of the housing 3. The pair of frame parts 11, 12 of the housing 3 extends vertically between the sidewall 5 and the inner liner 4. In more detail, a first frame part 11 extends from the middle of the housing 3 to the upper side in the vertical direction, and a second frame part 12 extends from the middle of the housing 3 to the lower side in the vertical direction. The reinforcing member 13 connects to the first frame part 11 from one side, and to the second frame part 12 from the other side. There is a hinge support part 10 provided in the hinge connection housing 9 on a side adjacent the reinforcing member 13. As can be seen in FIG.

6, the reinforcing member 13 and the frame parts 11, 12 are configured to extend in the vertical direction of the housing 3. At least a part of the reinforcing member 13 overlaps a part of the first frame part 11. Similarly, at least a part of the reinforcing member 13 overlaps a part of the second frame part 12. The reinforcing member 13 has one or more second connection hole 18 on a part of the reinforcing member 13 that is not overlapping with the respective frame parts 11, 12. In a possible embodiment, the reinforcing member 13 has two second connection holes 18.

Figure 7:
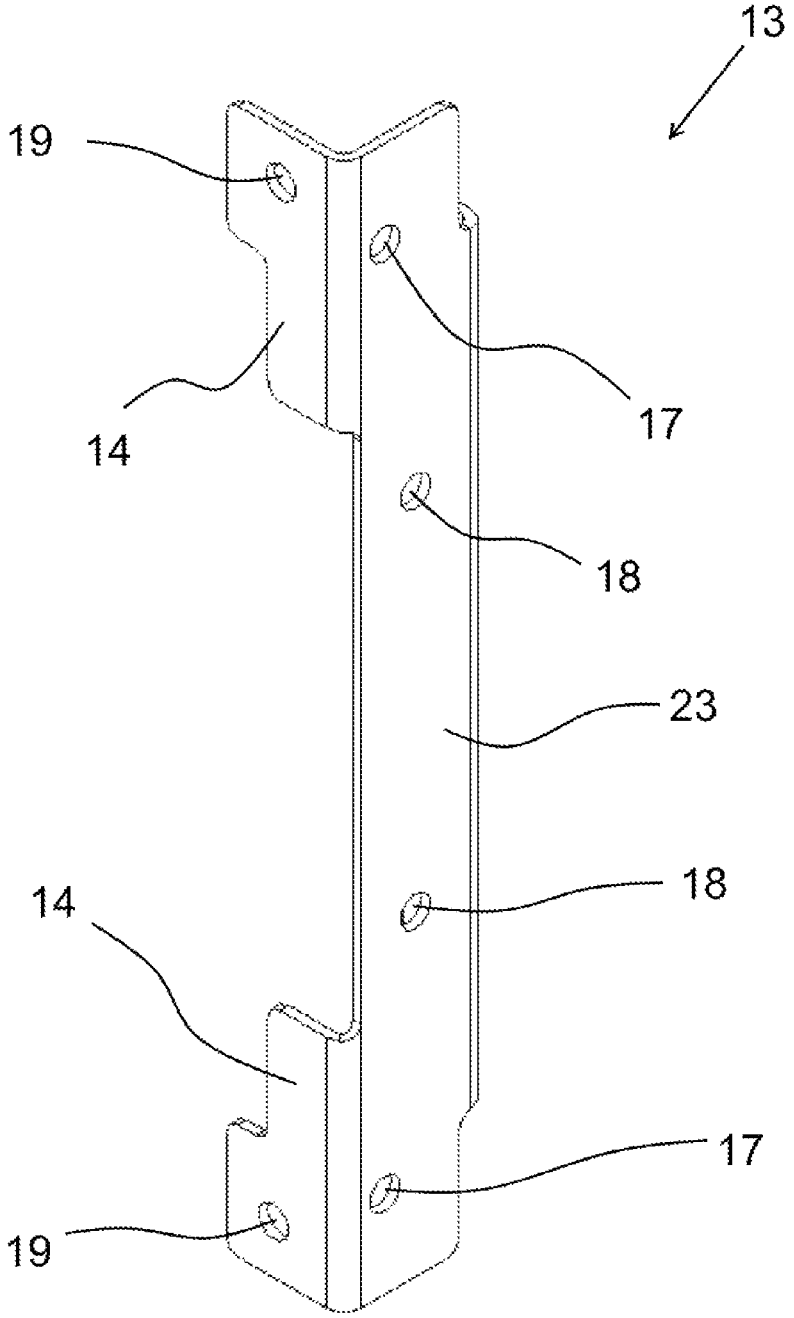
FIG. 7 is a perspective view of the reinforcing member.
Figure 8:
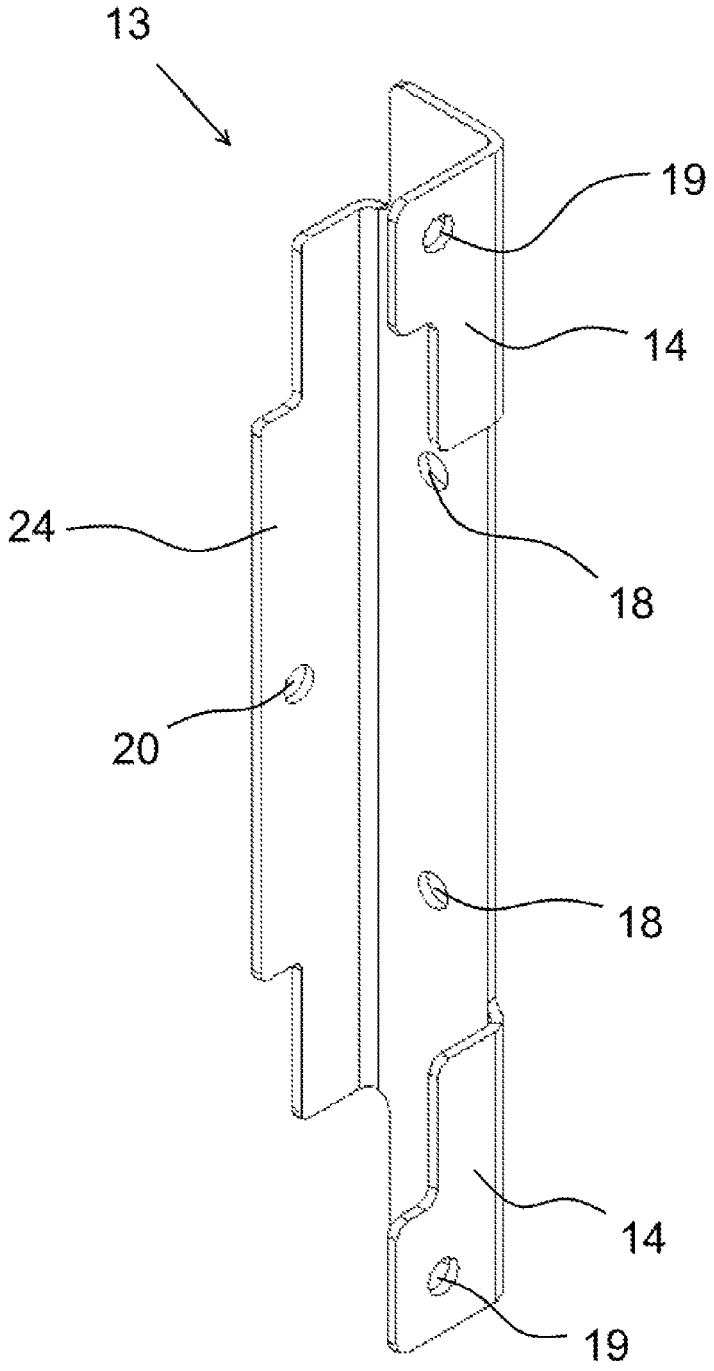
FIG. 8 is another perspective view of the reinforcing member.

With reference to FIGS. 7 and 8, in a possible embodiment, the reinforcing member 13 has three-sided connection surfaces. The reinforcing member 13 has a first side surface 23 facing the sidewall 5, where a plurality of connection holes 17, 18 are provided. The connection holes 17, 18 are spaced apart from each other in the vertical direction. The connection openings 21 of the sidewall 5 correspond to the connection holes 17, 18. In more detail, the first side surface 23 has one or more first connection holes 17 and one or more second connection holes 18. A connection element 22 passes through the first connection hole 17, the connection opening 21 of the sidewall 5 and the respective frame parts 11, 12. Thus, the reinforcing member 13 connects to the sidewall 5 and the respective frame parts 11, 12. A connection element 22 passes through the second connection hole 18 for connecting the reinforcing member 13 to the hinge support part 10 from outside of the housing 3. The reinforcing member 13 further includes two connection lugs 14 provided at the opposite sides. The connection lugs 14 at least partly overlap a part of the respective frame parts 11, 12. The connection lugs 14 are configured to extend in a direction perpendicular to the first side surface 23. Each of the connection lugs 14 have one or more third connection hole 19. A connection element passes through the third connection hole 19 and the respective frame parts 11, 12. Thus, the reinforcing member 13 connects to the first frame part 11 and the second frame part 12. The reinforcing member 13 has one or more fourth connection hole 20 provided on a second side surface 24 which is perpendicular to the first side surface 23. A connection element passes through the fourth connection hole 20 in order to connect the reinforcing member 13 to the hinge support part 10. In a possible embodiment, the reinforcing member 13 is made from a metal material, in particular a steel material.

The following is a summary list of reference numerals and the corresponding structure used in the above description of the invention:

1 Refrigeration device
2 Cabinet
3 Housing
4 Inner liner
5 Sidewall
6 Front frame part
7 Door
8 Hinge element
9 Hinge connection housing
10 Hinge support part
11 First frame part
12 Second frame part
13 Reinforcing member
14 Connection lug
15 First connection region
16 Second connection region
17 First connection hole
18 Second connection hole
19 Third connection hole
20 Fourth connection hole
21 Connection opening
22 Connection element
23 First side surface
24 Second side surface
A Detail A

The invention claimed is:

1. A refrigeration device, comprising:
a cabinet;
a thermally-insulated housing surrounding said cabinet, said housing having a sidewall facing outward and an inner liner spaced apart from said sidewall;
at least one door and at least one hinge element hinging said at least one door to said housing;
a front frame part provided at a side of said housing facing said at least one door;
said housing including a pair of frame parts being two mutually separate frame parts extending vertically between said sidewall and said inner liner; and
said housing including a reinforcing member being separate from said two separate frame parts and being provided at a region of said housing adjacent a respective hinge element, said reinforcing member connecting said two separate frame parts to each other, to said respective hinge element and to said sidewall.

2. The refrigeration device according to claim 1, wherein said reinforcing member is configured to extend in a vertical direction of said housing.

3. The refrigeration device according to claim 2, wherein said reinforcing member is located at a vertically middle region of said housing.

4. The refrigeration device according to claim 1, wherein said at least one door includes two doors, said at least one hinge element includes two hinge elements, said housing includes another reinforcing member, and said reinforcing members are disposed at opposite sides of said housing for regions of said housing adjacent each respective hinge elements for each respective door.

5. The refrigeration device according to claim 1, wherein said reinforcing member is made from a metal material or a steel material.

6. A refrigeration device, comprising:
a cabinet;
a thermally-insulated housing surrounding said cabinet, said housing having a sidewall facing outward and an inner liner spaced apart from said sidewall;
at least one door and at least one hinge element hinging said at least one door to said housing;
a front frame part provided at a side of said housing facing said at least one door;
said housing including a pair of frame parts extending vertically between said sidewall and said inner liner; and
said housing including a reinforcing member provided at a region of said housing adjacent a respective hinge element, said reinforcing member connecting said pair of frame parts to each other, to said respective hinge element and to said sidewall, and said reinforcing member having three-sided connection surfaces.

7. A refrigeration device, comprising:
a cabinet;
a thermally-insulated housing surrounding said cabinet, said housing having a sidewall facing outward and an inner liner spaced apart from said sidewall;
at least one door and at least one hinge element hinging said at least one door to said housing;

a front frame part provided at a side of said housing facing said at least one door;

said housing including a pair of frame parts extending vertically between said sidewall and said inner liner;

said housing including a reinforcing member provided at a region of said housing adjacent a respective hinge element, said reinforcing member connecting said pair of frame parts to each other, to said respective hinge element and to said sidewall, and said housing including a hinge connection housing at a location where said respective hinge element is connected to said housing on a front side of said housing facing said at least one door, and a hinge support part provided in said hinge connection housing.

8. The refrigeration device according to claim 7, wherein said reinforcing member has a first side surface facing said sidewall, and said first side surface has a plurality of connection holes formed therein.

9. The refrigeration device according to claim 8, wherein said sidewall has a plurality of connection openings formed therein corresponding to said connection holes.

10. The refrigeration device according to claim 8, wherein said plurality of connection holes formed in said first side surface includes at least one first connection hole, and a connection element passes through said first connection hole, said sidewall and a respective one of said frame parts to connect said reinforcing member to said sidewall and to said one respective frame part.

11. The refrigeration device according to claim 10, wherein said plurality of connection holes formed in said first side surface includes at least one second connection hole, and another connection element connects said reinforcing member to said hinge support part from outside of said housing.

12. The refrigeration device according to claim 10, wherein said reinforcing member includes two connection lugs provided at opposite sides of said reinforcing member, said connection lugs at least partly overlap a part of a respective one of said frame parts.

13. The refrigeration device according to claim 12, wherein each of said connection lugs has at least one third connection hole formed therein, and a connection element passes through a respective third connection hole and one of said respective frame parts for connecting said reinforcing member to said respective frame part.

14. The refrigeration device according to claim 13, wherein said reinforcing member has at least one fourth connection hole formed therein on a surface of said reinforcing member perpendicular to said first side surface.

* * * * *